US007261253B2

(12) United States Patent
Windo

(10) Patent No.: US 7,261,253 B2
(45) Date of Patent: Aug. 28, 2007

(54) REWIND ARMS FOR PLASTIC FILM SLITTING APPARATUS

(75) Inventor: Kevin P. Windo, Bedfordshire (GB)

(73) Assignee: Atlas Converting Equipment Limited, Bedfordshire (GB)

( * ) Notice: Subject to any disclaimer, the term of this patent is extended or adjusted under 35 U.S.C. 154(b) by 296 days.

(21) Appl. No.: 10/511,786

(22) PCT Filed: Apr. 14, 2003

(86) PCT No.: PCT/GB03/01628

§ 371 (c)(1),
(2), (4) Date: Oct. 15, 2004

(87) PCT Pub. No.: WO03/089352

PCT Pub. Date: Oct. 30, 2003

(65) Prior Publication Data

US 2005/0156079 A1 Jul. 21, 2005

(30) Foreign Application Priority Data

Apr. 16, 2002 (GB) ..... 0208688.2

(51) Int. Cl.
*B65H 75/24* (2006.01)

(52) U.S. Cl. ..... 242/578; 242/578.2; 242/599.3; 242/599.4

(58) Field of Classification Search ..... 242/578, 242/578.2, 599, 599.3, 599.4
See application file for complete search history.

(56) References Cited

U.S. PATENT DOCUMENTS

| | | | | |
|---|---|---|---|---|
| 2,733,020 | A * | 1/1956 | Keyser | 242/603 |
| 2,851,226 | A * | 9/1958 | Wellington | 242/532.5 |
| 3,179,349 | A * | 4/1965 | Aaron et al. | 242/530 |
| 3,337,145 | A * | 8/1967 | Keck | 242/486.8 |
| 4,200,245 | A * | 4/1980 | Bugnone | 242/533.6 |
| 4,741,490 | A * | 5/1988 | Evans | 242/421 |

* cited by examiner

*Primary Examiner*—Gene O. Crawford
*Assistant Examiner*—Sang Kim
(74) *Attorney, Agent, or Firm*—Horst M. Kasper

(57) ABSTRACT

A winding core 1 of small diameter is mounted at each end on a locking core chuck 3 coupled to a shaft 14 supported by spaced bearings 4 and 8 located within a housing part 5 at the free end 6 of a rewind arm structure. The central part of the shaft 14 has a pulley portion 12 over which a drive belt 13 runs. A larger core 2 is mounted at each end on a heavier duty locking core chuck 7 carried by larger bearings 8 which are located also within the housing 5. The housing 5 is cut away or stepped at 9 whereby a contact pressure roller 10 having a width greater than that of the core 1 may be accommodated and brought into contact with the core 1 at least at the minimum diameter thereof.

9 Claims, 4 Drawing Sheets

REWIND ARMS FOR PLASTIC FILM SLITTING APPARATUS

Figure 1:
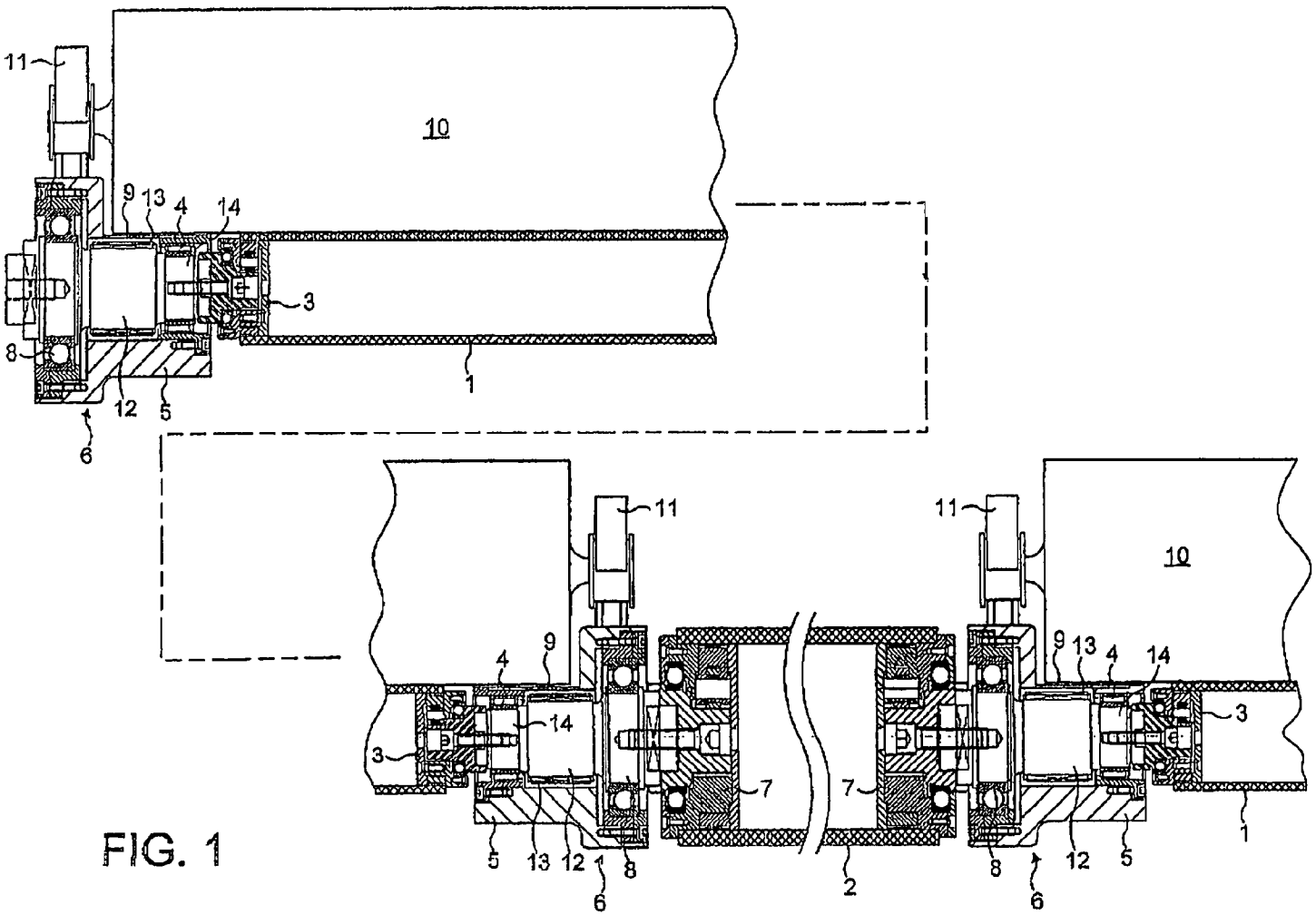

This invention relates to rewind arms for holding winding cores onto which plastics film is wound after processing on a slitter rewinder machine wherein a wide film is slit into lesser widths and wound onto cores for further use.

In such machines a wide roll of film is passed through a machine, cut or slit with blades longitudinally and the slit widths rewound individually onto cores using pairs of rewinding arms. There is a frequent requirement to rewind film onto paper cores of various diameters according to market requirements. Industrial standard core inside diameters are 76 mm and 152 mm. Slitter rewinder machine which achieve this use individual contact rollers and in view of the great variety of slit widths it is not practical to have a special length of contact roller for each individual slit width. Each contact roller is therefore of an extended length and the dimension of the top core holding zone of the rewind arm has to be limited in size to avoid the contact roller touching the arm at the overlaps each side of the core width. The design of the top of the rewind arm is therefore limited in size by the minimum core diameter that the machine is required to handle.

Hitherto machines have made use of two designs of rewind arms, one design to handle a minimum core size of 76 mm and the other to handle a minimum core of 152 mm diameters. This is due to the fact that a rewind top dimension which is suitable to hold a 76 mm core has mechanical components which are limited in size being the drive shaft and bearings and which are therefore not strong enough to process very heavy rewound rolls. The heavy rewound rolls are usually produced using 152 mm (or larger) cores. Because of the limited strength of a rewind arm for 76 mm cores, a minimum core internal diameter of 152 mm is often specified even though a capability of the machine to also handle 76 mm cores would be preferred.

An object of this invention is to provide a rewind arm for slitter rewinder machines which can accommodate different core diameters and which minimises interference with a contact roller.

Another object of this invention is to provide a rewind arm for slitter rewinder machines which can provide large diameter shafts, bearings and core chucks of 152 mm ID (and larger) rewind cores and whilst retaining the capability of handling 76 mm cores.

Although this invention is primarily directed to slitter rewinder machines the construction may be adopted for other applications where winding of sheet materials onto a core is required using a machine which may be adapted to different width or diameter cores.

According to this invention there is provided a rewind arm assembly primarily for a slitter rewinder machine of the kind having a base supporting two or more rewind arms in spaced relationship whereby a rewind core may be rotationally supported between two adjacent rewind arms, each arm having a core driving shaft for coupling with a core engaging and locking chuck, the shaft being carried by spaced bearing assemblies located in a housing at the top of each rewind arm, the rewind arms being supported on the machine base in a manner permitting traversing and adjustment of the spacing to accommodate differing rewind core widths, the machine further including a pressure contact roller which may be positioned in parallel, surface to surface, contact with a core and mounted on arms which pivot so as to accommodate the increasing core diameter as the core is wound during use, wherein one side of the top housing of the rewind arm has the core shaft and support bearings adapted to a first size of core internal diameter and the other side of the top of the rewind arm has the core shaft and support bearings adapted to a second size of core internal diameter.

Preferably the housing includes two sets of shaft supports and bearings which to one side has a lesser dimension than the other at least in zone of contact by a contact roller.

The housing may have, at the side having the lesser dimension shaft supports and bearings, a stepped part of reduced external profile in the zone of a contact roller.

The contact roller may extend across the stepped part of the housing of the rewind arm without interference with or fouling of the arm when adjacent arms are spaced less than the contact roller length to accommodate a core shorter than the contact roller.

Preferably each bearing assembly has a maximum circumferential dimension less than the diameter of a relevant core, the stepped part being formed on the part of the housing embracing at least the bearing assembly for the lesser dimension shaft, the stepped part comprising a planar face of the housing extending parallel to the core axis and tangential to the point of contact between the contact roller and core.

In one preferred construction the one side of the top housing of the rewind arm is coextensive with the side of the arm and includes a core shaft and support bearings adapted to a first size of core internal diameter and the other side of the housing has the core shaft and support bearings adapted to a second size of core internal diameter, the core shafts being connected through a central pulley located within the housing and coupled through a drive belt with a motor housed in the base of the arm for the purpose of rotating the core shafts. Preferably the drive belt and pulley are toothed.

In the above case the stepped part may extend across the zone of the pulley.

This invention also relates to a slitter rewinder machine wherein a wide film is slit into lesser widths and wound onto cores for further use, said machine incorporating at least two rewind arms, in accordance with any preceding claim, for holding a winding core.

Thus, and according to this invention, the rewind arm assembly has one side of the top of the rewind arm with a core shaft and support bearings adapted to a first size of core internal diameter and the other side of the top of the rewind arm has core shaft and support bearings adapted to a second size of core internal diameter.

With this construction the top of the rewind arm may thus have a housing for the two sets of shaft supports and bearings which to one side has a lesser dimension than the other at least in zone of the contact roller. The top housing thus being stepped. This allows the contact roller to extend laterally beyond the top part of the support arm without interference with or fouling the arm when a smaller diameter core is being wound. Naturally the contact roller can only extend widthways up to the steps on each support arm but nevertheless this means that a single contact roller may be used with a range of slit widths for smaller size cores.

Figure 2:
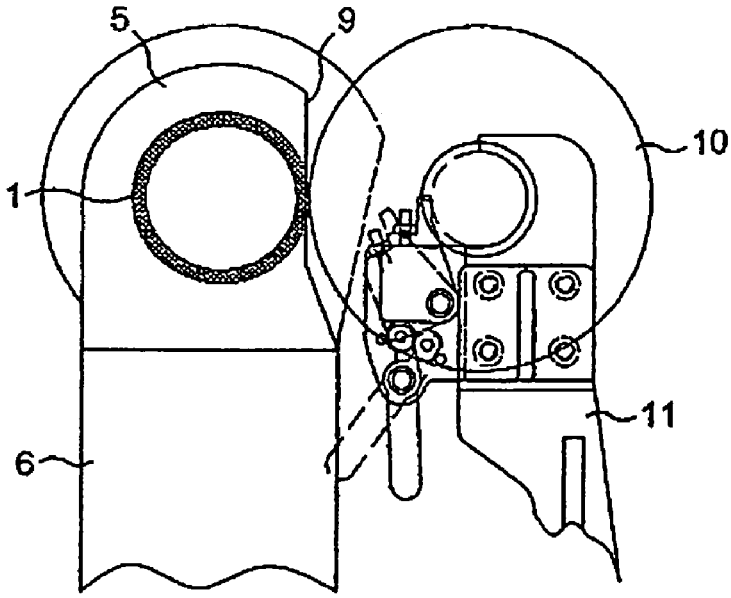
Figure 3:
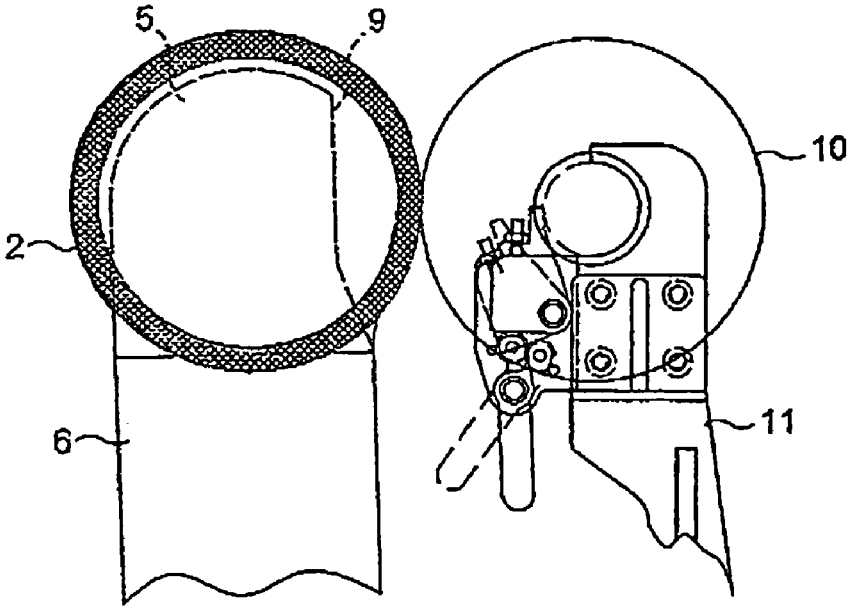
Figure 4:
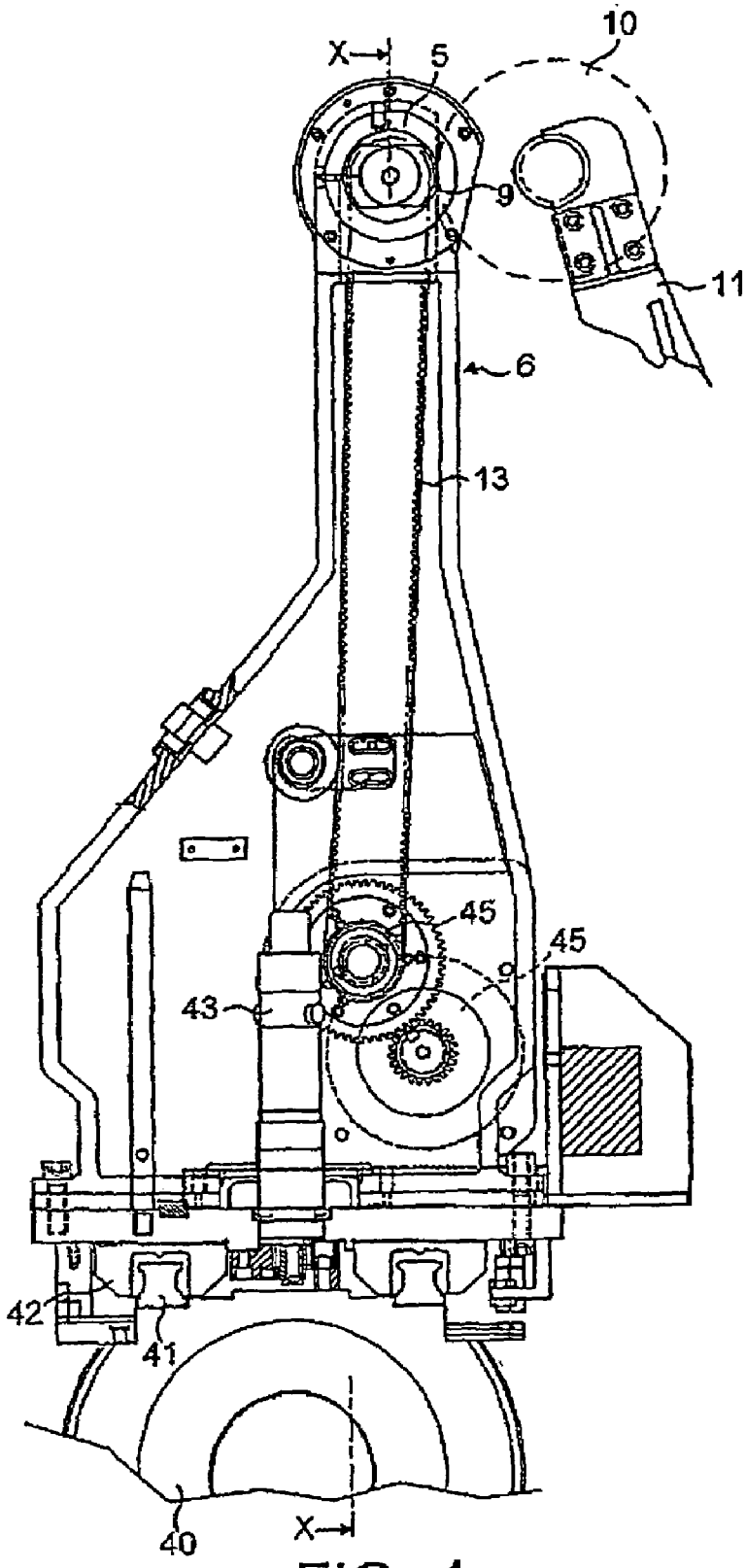
Figure 5:
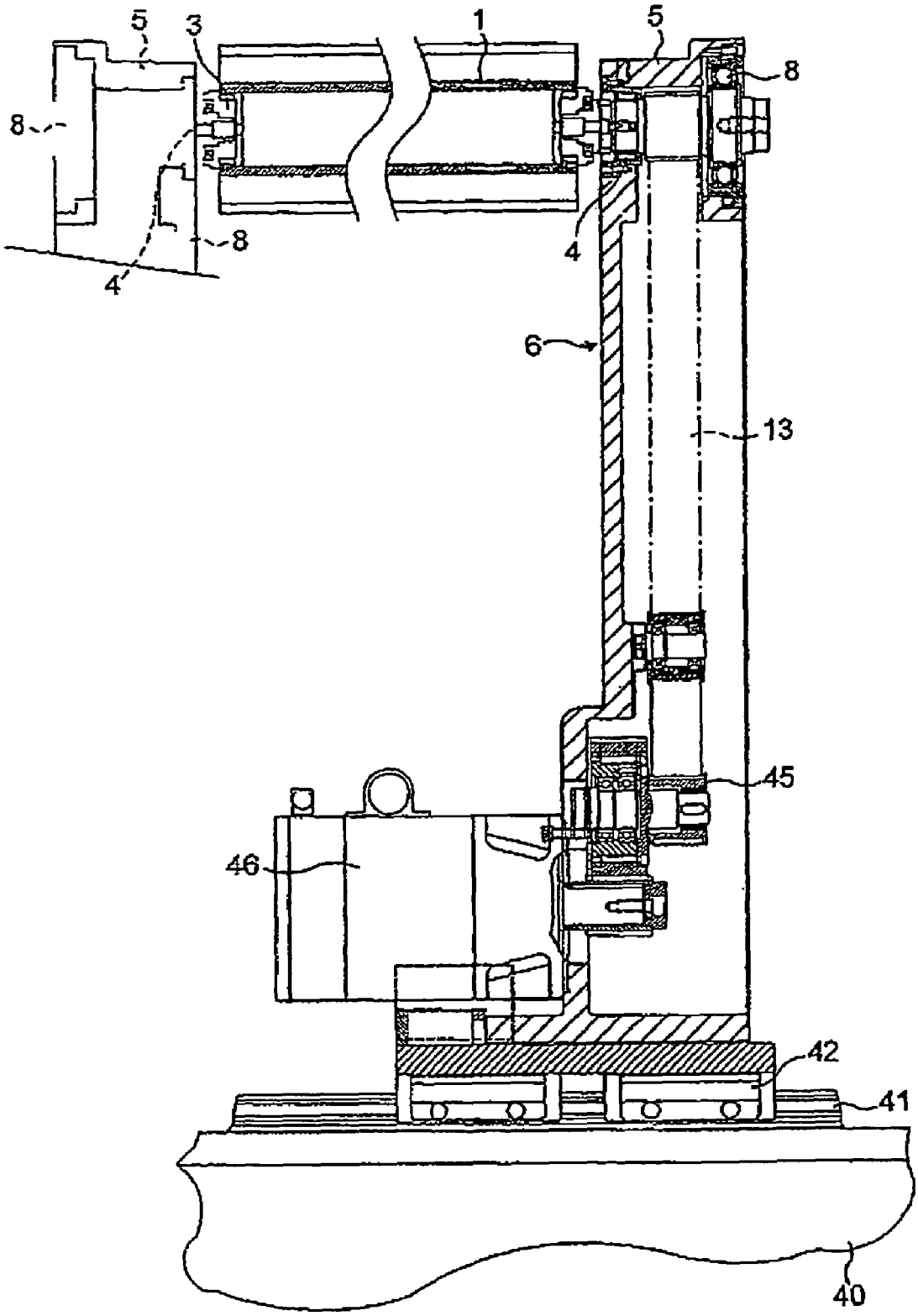

This invention, and further and preferred features thereof are described in conjunction with the drawings showing one embodiment by way of an example. In the drawings:

FIG. 1 shows a longitudinal section through two diameters of core mounted on support arms of a slitter rewinder machine according to this invention, FIG. 2 shows an end view of a smaller diameter core and support arm, FIG. 3 shows an end view of a larger diameter core and support arm, FIG. 4 shows one support arm in side elevation and viewed from the right as shown in FIG. 1, and FIG. 5 shows a sectional view on the line X-X as shown in FIG. 4.

The drawings do not illustrate complete details of the machine but only show the ends of the rewind arms and associated parts relevant to this invention.

Referring to the drawings, and initially to FIGS. 1 to 3 there is shown a winding core 1 of 76 mm diameter and a winding core 2 of 152 mm diameter. The core 1 is mounted at each end on a locking core chuck 3 coupled to a shaft 14 supported by spaced bearings 4 and 8 located within a housing part 5 at the free end 6 of a rewind arm structure. The central part of the shaft 14 has a pulley portion 12 over which a drive belt 13 runs with the other end coupled to a drive means. The arm 6 is generally mounted on the bed of the machine and in a manner permitting swinging movement of the core in a direction perpendicular to the core axis of rotation. The larger core 2 is mounted at each end on a heavier duty locking core chuck 7 carried by larger bearings 8 which are located also within the housing 5.

The housing 5 is cut away or stepped at 9 whereby a contact pressure roller 10 having a width greater than that of the core 1 may be accommodated and brought into contact with the core 1 at least at the minimum diameter thereof. The contact roller 10 is supported on a pressure arm assembly 11 not shown here in detail. The stepped part 9 of the housing 5 on each arm enables a larger and more substantial bearing assembly 8 to be provided for the larger diameter cores 2 whilst retaining a common drive shaft arrangement. In the drawings the core 2 is shown as idle that is the relevant pressure roller and pressure arm assembly is not shown.

To change from smaller to larger diameter cores does not require a change to be made to the rewind arms 6 themselves but the arms need only be moved laterally or reversed to accommodate the required core size. The cores 2 can be used with wider contact rollers 10 which will then overlie the housings 5 without interference.

A slitter rewinder machine may include all of the arms 6 in accordance with this invention or some arms only may be provided.

It will be understood that parts of the slitter rewinder machine are not described as these are known in the art and do not form an essential part of this invention other than in combination with the rewind arms described.

In order to explain further the way the construction described is put into practice reference is now made to FIGS. 4 and 5 of the drawings. FIG. 4 shows one rewind arm 6 in side elevation and viewed from the right as shown in FIG. 1. FIG. 5 is a sectional view on the line X-X shown in FIG. 4. The reference numerals generally indicate the same parts as those used in FIGS. 1 to 3.

The rewind arm 6 shown is mounted on a transverse support beam 40 forming part of the machine bed and is supported on rails 41 by runners 42 permitting the arm to be moved along the beam 40 by a drive motor 43 to a selected core engaging position or an idle position if the arm is not in use. The core 1 is driven via the chuck 3 through a drive belt 13 running over the pulley 12 within the housing 5 and engaging a pulley 45 within the lower end of arm 6 the pulley being driven through a gear set by a motor 46. The pressure roller 10 is permitted to contact the core 1 through the stepped portion 9 of the housing 5.

The invention claimed is:

1. A rewind arm assembly primarily for a slitter rewinder machine having a base supporting two or more rewind arms in spaced relationship, a rewind core rotationally supported between two adjacent rewind arms, each arm having a core driving shaft for coupling with a core engaging and locking chuck, the shaft being carried by spaced bearing assemblies located in a housing at the top of each rewind arm, the rewind arms being supported on said base for traversing and adjustment of the spacing between adjacent arms to accommodate differing rewind core widths, the machine further including a pressure contact roller positioned in parallel, surface to surface, contact with the core and mounted on arms which pivot so as to accommodate the increasing core diameter as the core is wound during use, wherein one side of the top housing of the rewind arm has the core shaft and support bearings adapted to the loads imposed by a first size of core internal diameter and the other side of the top of the rewind arm has the core shaft, and support bearings adapted to the loads imposed by a second size of core internal diameter.

2. A rewind arm assembly in accordance with claim 1, wherein the housing includes two sets of shaft supports and bearings which to one side has a lesser dimension than the other at least in zone of contact by the contact roller.

3. A rewind arm assembly in accordance with claim 2, wherein the housing at the side having the lesser dimension shaft supports and bearings has a stepped part of reduced external profile in the zone of contact by the contact roller.

4. A rewind arm assembly in accordance with claim 3, wherein the contact roller may extend across the stepped part of the housing of the rewind arm without interference with or fouling of the arm when adjacent arms are spaced less than the contact roller length to accommodate a core shorter than the contact roller.

5. A rewind arm assembly in accordance with claim 4, wherein the stepped part is formed on the part of the housing embracing at least the bearing assembly for the lesser dimension shaft, the stepped part comprising a planar face of the housing extending parallel to the core axis and tangential to the point of contact between the contact roller and core.

6. A rewind arm assembly in accordance with claim 1, wherein the one side of the top housing of the rewind arm is coextensive with the side of the arm and includes the core shaft and support bearings adapted to the loads imposed by a first size of core internal diameter and the other side of the housing has the core shaft and support bearings adapted to the loads imposed by a second size of core internal diameter, the core shafts being connected through a central pulley located within the housing and coupled through a drive belt with a motor housed in the base of the arm for the purpose of rotating the core shafts.

7. A rewind arm assembly in accordance with claim 6, wherein the drive belt and pulley are toothed.

8. A rewind arm assembly in accordance with claim 6, wherein the stepped part extends across the zone of the pulley.

9. A slitter rewinder machine wherein a wide film is slit into lesser widths and wound onto cores for further use, said machine incorporating at least two rewind arms, in accordance with claim 1, for holding a winding core.

* * * * *